US006034475A

United States Patent [19]

Yoon

[11] Patent Number: 6,034,475

[45] Date of Patent: Mar. 7, 2000

[54] PLASMA DISPLAY WITH SPECIFIC THERMAL EXPANSION COEFFICIENTS FOR SUBSTRATE RIBS AND DIELECTRIC LAYER

[75] Inventor: Jeong-Soo Yoon, Kyongsangbuk-do, Rep. of Korea

[73] Assignee: LG Electronics Inc., Seoul, Rep. of Korea

[21] Appl. No.: 08/978,978

[22] Filed: Nov. 26, 1997

[30] Foreign Application Priority Data

Nov. 30, 1996 [KR] Rep. of Korea ..... 96-60302

[51] Int. Cl.[7] ..... H01J 17/58

[52] U.S. Cl. ..... 313/586; 313/582; 313/583; 313/584

[58] Field of Search ..... 313/567, 573, 313/586, 609, 610, 611, 634, 635

[56] References Cited

U.S. PATENT DOCUMENTS

| | | | |
|---|---|---|---|
| 4,475,060 | 10/1984 | Aboelfotoh | 313/587 |
| 4,613,399 | 9/1986 | Kobale et al. | 156/634 |
| 5,684,361 | 11/1997 | Seki | 313/582 |
| 5,684,362 | 11/1997 | Togawa | 313/582 |
| 5,714,840 | 2/1998 | Tanabe et al. | 313/581 |
| 5,717,287 | 2/1998 | Amrine et al. | 313/495 |

*Primary Examiner*—Vip Patel
*Assistant Examiner*—Matthew J. Gerike
*Attorney, Agent, or Firm*—Finnegan, Henderson, Farabow, Garrett & Dunner, L.L.P.

[57] ABSTRACT

A plasma display panel having a glass substrate, a dielectric layer over the glass substrate and one or more barrier ribs over the dielectric layer, and a method of manufacturing thereof. In the plasma display panel, the thermal expansion coefficients of the glass substrate and the barrier ribs are greater than that of the dielectric layer. The dielectric layer is 80~83×$10^{-7}$/° C. and the glass substrate and barrier ribs are 84~87×$10^{-7}$/° C. in thermal expansion coefficient.

6 Claims, 1 Drawing Sheet

PLASMA DISPLAY WITH SPECIFIC THERMAL EXPANSION COEFFICIENTS FOR SUBSTRATE RIBS AND DIELECTRIC LAYER

BACKGROUND OF THE INVENTION

A. Field of the Invention

The present invention relates to a composition of and method of manufacturing a plasma display panel.

B. Description of Prior Art

The prior art will be described with reference to FIGS. 1 and 2. The conventional printing technique, used for the manufacture of a plasma display panel, controls the ratio of temperature rise/drop only, having no consideration for thermal expansion coefficients of paste materials used therefor, which takes time and entails cracks in materials forming the interior of the panel because of sudden variation of temperature. After firing the barrier ribs, the bottom parts of the barrier ribs 3 on a dielectric layer 4 are broken into scale-like pieces, or the barrier ribs 3 are broken off at the middle part.

Since the manufacture of the lower panel of a plasma display requires a lot of firing steps, the optimum thermal expansion coefficient for each material should be taken into account from production yield aspect.

The conventional art will be described in greater detail. A glass 1 is first cleanly washed by a wet-cleaning equipment, and address electrodes 2 are formed on the glass 1 by a printing technique by the use of Ag paste and a screen mask. After that, drying and firing are performed with respect thereto. The thermal expansion coefficient of the glass 1 equals $76\times10^{-7}/°$ C. In the formation of the barrier ribs 3, a thermal expansion coefficient of the material forming the barrier ribs 3 equals $86\times10^{-7}/°$ C. The barrier ribs 3 are formed to a height of 150 $\mu$m by repeatedly performing printing and drying processes about 10 times, and, as shown in FIG. 2, the resultant material is fired for 60 minutes at 580° C. It takes four hours and fifty minutes to make the temperature rise, and that is, the temperature rises by 2° C. a minute. Making the temperature drop takes nine hours and thirty minutes, and the temperature drops by 1° C. a minute. The overall time required for the firing is 15 hours and twenty minutes, thus lowering the production yield.

SUMMARY OF THE INVENTION

Accordingly, the present invention is directed to a composition of and method of manufacturing a plasma display panel that substantially obviates one or more of the problems due to limitations and disadvantages of the related art.

It is an object of the present invention to provide a composition of a plasma display panel which can eliminate defects such as cracks and reduce the time required for firing, with selection of an optimum thermal expansion coefficient for each material of the composition and optimum arrangement of those materials.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a plasma display panel including a glass substrate having a first thermal expansion coefficient; a dielectric layer over the glass substrate, wherein the dielectric layer has a second thermal expansion coefficient less than the first thermal expansion coefficient; and one or more barrier ribs over the dielectric layer, wherein the barrier ribs have a third thermal expansion coefficient greater than the second thermal expansion coefficient.

The invention further comprises a method of manufacturing a plasma display panel, including forming a glass substrate having a first thermal expansion coefficient; forming a dielectric layer over the glass substrate, wherein the dielectric layer has a second thermal expansion coefficient less than the first thermal expansion coefficient. The method further includes forming one or more barrier ribs over the dielectric layer, wherein the barrier ribs have a third thermal expansion coefficient greater than the second thermal expansion coefficient.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

BRIEF DESCRIPTION OF THE ATTACHED DRAWINGS

DETAILED DESCRIPTION OF PREFERRED EMBODIMENT

Reference will now be made in detail to the preferred embodiments of the present invention, examples of which are illustrated in the accompanying drawings.

In the manufacture of a plasma display panel, the present invention reduces the time required for firing by finding out the interaction of materials through selection of an optimum thermal expansion coefficient for each material and several tests, thus having an advantageous yield aspect.

A window glass 1 is thoroughly washed by a wet-cleaning equipment, and printing is performed with respect to the window glass 1. In printing after drying and firing, the first test employs a glass with a thermal expansion coefficient of $85\times10^{-7}/°$ C., as shown in Table 1 (showing the result of thermal expansion coefficient test). A dielectric layer with a thermal expansion coefficient of $81\times10^{-7}/°$ C., is formed over the electrodes to a thickness of 20 to 30 $\mu$m, and goes under drying and firing, and then the barrier ribs are formed.

The glass, the dielectric layer and the barrier ribs of the prior art and of the present invention are of a generic glass type, and have $SiO_2$, $Al_2O$ and PbO as main ingredients. In addition, materials such as $CaCo_3$ and $TiO_2$ are added to these main ingredients to impart varying thermal expansion coefficients. The materials used in the embodiment of the present invention were obtained from Japanese glass manufacturers, such as Noritake and Ashai Glass.

It is quite difficult and complicated to manufacture the barrier ribs, and a 10-time deposition printing must be carried out to form a thick layer of 150 $\mu$m. A thermal expansion coefficient of the material forming the barrier ribs is $85\times10^{-7}/°$ C., and is the same as that of the glass.

TABLE 1

Test for Thermal Expansion Coefficient of Each Material

| Test Number | Material | *TEC | Thermal expansion | Result |
|---|---|---|---|---|
| 1 | Glass | $85 \times 10^{-7}/°$ C. | large | No defect |
| | Dielectric | $81 \times 10^{-7}/°$ C. | small | |
| | Rib | $85 \times 10^{-7}/°$ C. | large | |
| 2 | Glass | $75 \times 10^{-7}/°$ C. | small | Defect occurs |
| | Dielectric | $85 \times 10^{-7}/°$ C. | large | |
| | Rib | $85 \times 10^{-7}/°$ C. | large | |
| 3 | Glass | $85 \times 10^{-7}/°$ C. | large | Defect occurs |
| | Dielectric | $80 \times 10^{-7}/°$ C. | medium | |
| | Rib | $75 \times 10^{-7}/°$ C. | small | |

*TEC: Thermal expansion coefficient

Figure 1:
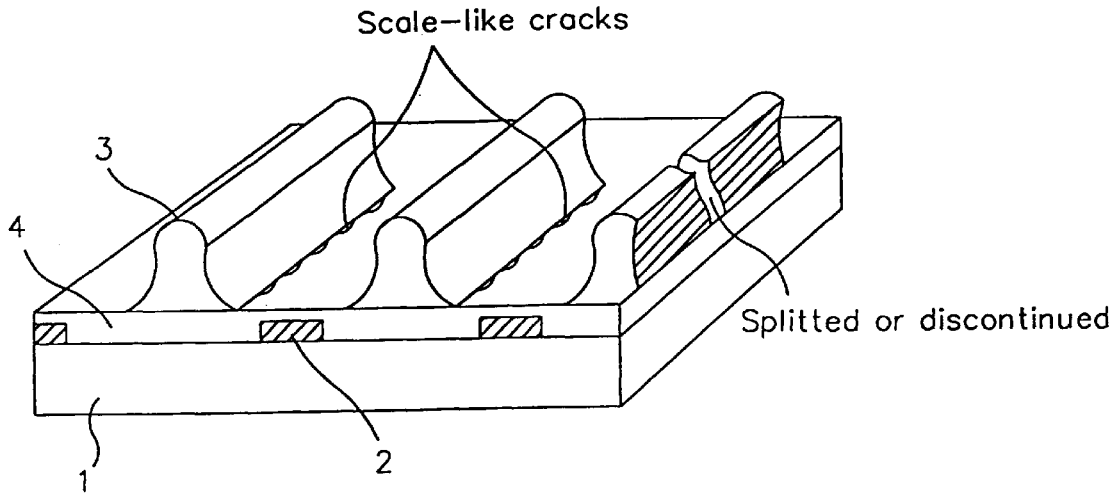
FIG. 1 depicts a conventional plasma display panel with defects.
Figure 2:
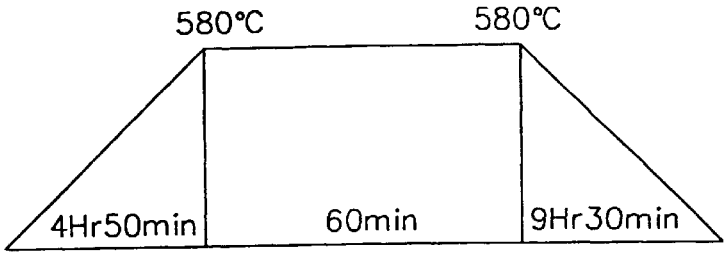
PRIOR ART Fig. 2
FIG. 2 is a firing profile of a conventional barrier rib.
Figure 3:
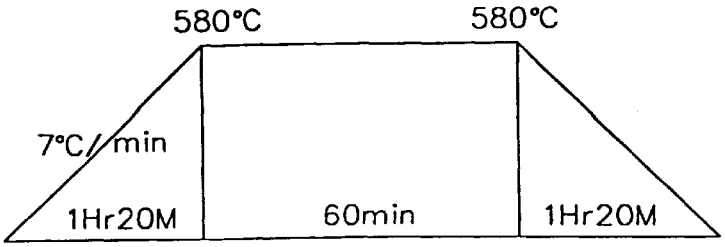
PRIOR ART Fig. 3
FIG. 3 is a firing profile of a barrier rib in accordance with the present invention.

FIG. 3 shows a firing temperature profile during drying and firing after printing of the barrier ribs 3. The starting temperature is about 20° C., and the rate of temperatures rise/temperature drop is approximately 7° C./min, and the temperature is maintained at about 580° C. for about 60 minutes, thus reducing the time required for firing to about three hours and thirty minutes. As a result, no defect is found in the panel, and, particularly, there is no minute crack between the barrier ribs 3 and the dielectric layer 4. According to the trend of the thermal expansion coefficients of the materials, the printing is carried out so as to deposit materials on the glass substrate in the order of large, small and large thermal expansion coefficients.

In the second test shown in Table 1, a lower panel is manufactured in the same manner as in the first test, and the materials to be deposited have different thermal expansion coefficients. According to the trend of the thermal expansion coefficients of the materials, the printing is carried out to deposit materials on the substrate in the order of small, large and large thermal expansion coefficients, and after the firing work is performed for three hours and thirty minutes, significant defects occur, thus failing to manufacture a defect-free lower panel.

In the third test, deposition printing is carried out in the same manner as in the second test, and, as shown in Table 1, materials with different thermal expansion coefficients are used. That is, a thermal expansion coefficient of the glass is $85\times10^{-7}/°$ C., while that of the dielectric layer is $80\times10^{-7}/°$ C. The thermal expansion coefficient of the material used for the barrier ribs is $75\times10^{-7}/°$ C. The firing temperature is the same as that of the respective first and second tests, and a lower panel is not properly manufactured under the condition of the third test. Materials are deposited in the order of large, medium and small thermal expansion coefficients.

In conclusion, the present invention employs the optimum thermal expansion coefficient for each material during deposition printing for the manufacture of a lower panel of a plasma display, thus reducing the time required for the firing (fifteen hours, conventionally) to about three hours. According to the present invention, the deposition mechanism which may eliminate occurrence of cracks is shown in Table 2.

TABLE 2

Arrangement of Material of Thermal Expansion Coefficients

| | |
|---|---|
| Barrier rib | $84\sim87 \times 10^{-7}/°$ C. |
| Dielectric layer | $80\sim83 \times 10^{-7}/°$ C. |
| Glass | $84\sim87 \times 10^{-7}/°$ C. |

It will be apparent to those skilled in the art that various modifications and variations can be made in the composition of a plasma display panel of the present invention without departing from the spirit or scope of the invention. Thus, other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A plasma display panel, comprising:

a glass substrate having a first thermal expansion coefficient;

a dielectric layer over said glass substrate, said dielectric layer having a second thermal expansion coefficient less than said first thermal expansion coefficient; and one or more barrier ribs over said dielectric layer, said one or more barrier ribs having a third thermal expansion coefficient greater than said second thermal expansion coefficient.

2. The plasma display panel according to claim 1, wherein said first thermal expansion coefficient is $84\sim87\times10^{-7}/°$ C.

3. The plasma display panel according to claim 1, wherein said second thermal expansion coefficient is $80\sim83\times10^{-7}/°$ C.

4. The plasma display panel according to claim 1, wherein said third thermal expansion coefficient is $84\sim87\times10^{-7}/°$ C.

5. The plasma display panel according to claim 1, wherein said first and third thermal expansion coefficients are $84\sim87\times10^{-7}/°$ C. and said second thermal expansion coefficient is $80\sim83\times10^{-7}/°$ C.

6. The plasma display panel of claim 1, wherein the glass substrate is in direct contact with the dielectric layer, and the dielectric layer is in direct contact with the one or more barrier ribs.

* * * * *